United States Patent [19]

Jackson

[11] Patent Number: 4,623,146

[45] Date of Patent: Nov. 18, 1986

[54] EXERCISE DEVICE

[76] Inventor: Byron R. Jackson, 30 Searing St., Hempstead, N.Y. 11550

[21] Appl. No.: 401,897

[22] Filed: Jul. 26, 1982

[51] Int. Cl.[4] ..... A63B 21/02

[52] U.S. Cl. ..... 272/137; 272/123; 272/126; 272/135

[58] Field of Search ..... 272/117, 122, 123, 116, 272/143, 141, 68, 93, 125, 127, 128, 135, 137, 142, 126

[56] References Cited

U.S. PATENT DOCUMENTS

| | | | |
|---|---|---|---|
| 818,242 | 4/1906 | Geisel | 272/141 |
| 1,035,252 | 8/1912 | Smith . | |
| 2,714,008 | 7/1955 | Urban . | |
| 3,006,646 | 10/1961 | Nanni . | |
| 3,117,781 | 1/1964 | Vargo | 272/125 |
| 3,343,837 | 9/1967 | Grzybowski . | |
| 3,516,661 | 6/1970 | Hansen . | |
| 3,545,121 | 12/1970 | Misko | 272/128 X |
| 3,588,102 | 6/1971 | Gifford . | |
| 3,637,205 | 1/1972 | Bankston | 272/68 |
| 3,638,939 | 2/1972 | Langley | 272/127 |
| 3,756,597 | 9/1973 | Monti | 272/123 |
| 3,820,781 | 6/1974 | Kane | 272/117 X |
| 3,942,790 | 3/1976 | Rice . | |
| 3,971,255 | 7/1976 | Varney et al. | 272/143 X |
| 4,193,593 | 3/1980 | Wilson . | |
| 4,257,591 | 3/1981 | Evans, Sr. | 272/143 X |
| 4,274,628 | 6/1981 | Hoagland | 272/123 |
| 4,395,039 | 7/1983 | Kaiser | 272/142 X |

FOREIGN PATENT DOCUMENTS

| | | | |
|---|---|---|---|
| 249890 | 5/1948 | Switzerland | 272/141 |
| 855312 | 11/1960 | United Kingdom | 272/128 |

*Primary Examiner*—Richard J. Apley
*Assistant Examiner*—John L. Welsh
*Attorney, Agent, or Firm*—Fitzpatrick, Cella Harper & Scinto

[57] ABSTRACT

An exercise device which has an elongate bar and a pair of weights, each removably mounted on one opposite end of the bar. A cushion tube, shorter than the bar, is mounted through antifriction bearings for rotary and axial sliding movement in telescoping relation about the bar. A sleeve is fixed to the center of the bar, and has outside diameter larger than the inside diameter of the antifriction bearings but smaller than the inside diameter of the tube to limit the extent of the axial sliding movement of the cushion tube relative to the bar and to confine the tube to positions generally at the center of the bar. One hand grip projects from each end of the bar in generally mutually co-planar relation therewith.

8 Claims, 8 Drawing Figures

EXERCISE DEVICE

BACKGROUND OF THE INVENTION

1. Field of the Invention

The present invention relates to an exercise device believed to have particular utility for stretching, firming, and eventually reducing the midsection of the exerciser.

2. Description of the Prior Art

Various exercise devices are presently known. For example, U.S. Pat. No. 4,257,591 (Evans, Sr.) relates to an exercising device that comprises a bar, the length of which may be varied, having hand grips at each of its opposing ends. A cushion encircles the bar at its center. In use, the bar is first adjusted to an appropriate length and then placed behind the head of the exerciser with the cushion in contact with the back of his or her neck. In an exercise regimen, the exerciser grasps the hand grips and twists from side to side and/or dips alternatively with each hand.

U.S. Pat. No. 3,006,646 (Nanni) relates to an exercise device that includes a hollow tube in which a weight is slidably mounted.

Devices in which a user exerts effort against the force of a spring in various ways are disclosed in U.S. Pat. Nos. 2,714,008 (Urban); 3,343,837 (Grzybowski); and 4,193,593 (Wilson).

Still other forms of exercise devices are disclosed in U.S. Pat. Nos. 1,035,252 (Smith); 3,516,661 (Hansen); 3,588,102 (Gifford); and 3,942,790 (Rice).

SUMMARY OF THE INVENTION

In its preferred embodiment, the present invention is designed specifically for exercising muscles of the abdominal and dorsal groups. However, it may be used in other ways to exercise other muscles.

Accordingly, it is an object of the present invention to provide an exercise device believed to effectively stretch, firm, and tone muscles in the abdominal and dorsal groups and eventually reduce the quantity of unwanted fat in and about these groups.

It is a further object of the present invention to provide a simple exercise device that may be easily used by an exerciser and that is believed to provide noticeable improvement in the firmness and muscle tone of those muscles exercised.

The present invention comprises an elongate bar and a pair of weights each removably mountable on an opposite end of the bar. A cushioned tube, that is shorter than the bar, is carried in telescoping relation at a location intermediate the ends of the bar. Antifriction bearings mount the tube for axial slidng movement and for rotary movement relative to the bar at this location.

In its preferred form, the exercise device of the present invention also comprises a sleeve mounted in fixed position at the center of the bar and having an outside diameter larger than the inside diameter of each of the antifriction bearings but smaller than the inside diameter of the tube. A coil spring loosely encircles the bar between each of the antifriction bearings and the sleeve to thereby resiliently resist approach of either of the bearings toward the sleeve and limit the extent of axial sliding movement of the tube on the bar.

A hand grip projects from the bar in the region of each of its ends and in mutually coplanar relation with the other hand grip and with the bar.

The exercise device of the present invention may be used in a regimen of several exercises described in greater detail below believed to accomplish the desired muscle stretching, firming, and toning objectives.

These and other objects of the exercise device of the present invention will be pointed out in or will be apparent from the detailed description provided below in conjunction with the accompanying drawings.

DETAILED DESCRIPTION OF THE PREFERRED EMBODIMENT

The exercise device of the present invention, generally indicated at 10, is designed to stretch, firm, and tone the muscles of the abdominal and dorsal groups and to reduce the amount of fat in and about these areas. More particularly, when used in one exercise regimen to be described below, the exercise device of the present invention is believed to primarily exercise the transversalis abdominis and the obliquus externus abdominis muscles. The exercise device of the present invention is believed to primarily flex and exercise various muscles of the dorsal group, including the erector spinae, sacrolumbalis, and latissimus dorsi muscles when used in a second regimen also described below.

Figure 1:
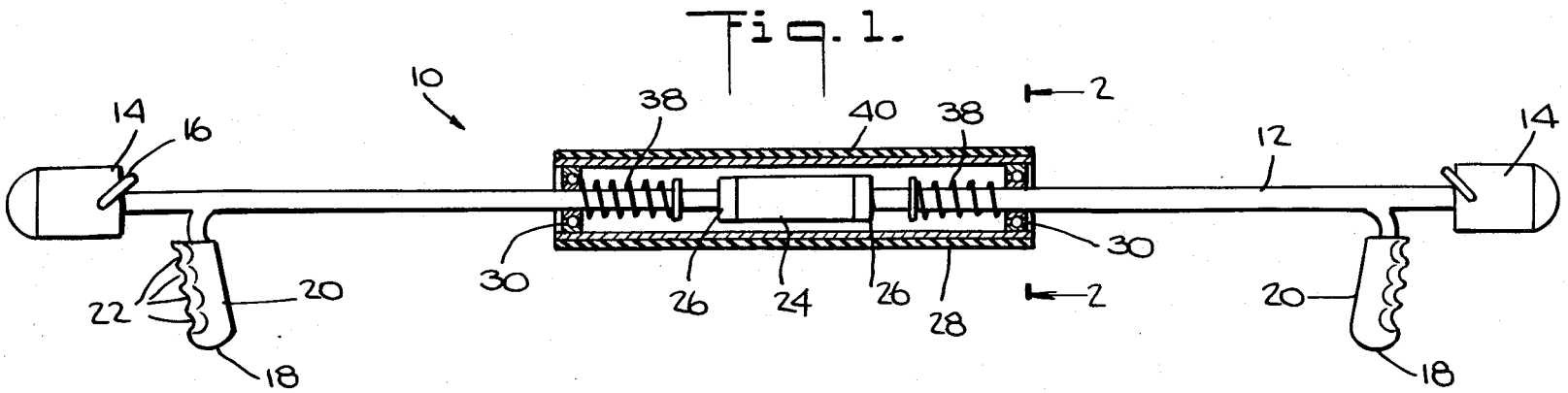
FIG. 1 is a elevational view of the exercise device in accordance with the preferred embodiment of the present invention, partly broken away to show internal detail.

As shown in detail in FIG. 1, the exercise device in accordance with the preferred embodiment of the present invention includes an elongate bar 12 that may be made of any suitable rigid, hollow or solid material, such as metal or plastic. Each end of the bar is adapted to receive a removably mountable weight 14 thereon. Each weight may include a set screw or lever mechanism 16 to securely fasten it to the bar in a well-known manner.

As further shown in FIG. 1, the bar may be integrally formed with a pair of hand grips 18, each depending in generally perpendicular relation from the region of one end of the bar. Each hand grip may be provided with a covering 20 having a number of finger depressions 22 to separate the fingers of an exerciser's hands and improve his comfort. Of course, the hand grips may be attached to the bar rather than being integrally formed therewith and may be mounted for adjustment relative to one another to accommodate different arm spans of different exercisers for practicing the exercise regimens described below.

The exercise device of the present invention also includes a sleeve 24 mounted in fixed position approximately at the center of the bar and having an outside diameter larger than that of the bar to present opposing shoulders 26 that face opposite bar ends.

A cushion tube 28 is mounted in telescoping relation about the bar and sleeve and has an inside diameter larger than the outside diameter of the sleeve.

Figure 2:
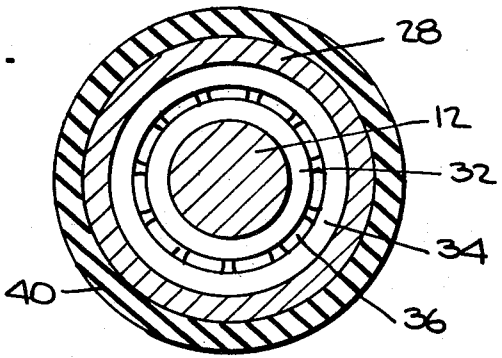
FIG. 2 is a vertical cross-sectional view taken through plane 2—2 in FIG. 1.

An antifriction bearing 30 is mounted in each opposing end of the cushion tube 28. As shown in FIG. 2, which is representative of both bearings, each comprises an inner race or bushing 32 mounted for axial sliding movement on the bar 12 and an outer race 34 carried on the inner race 32 by a plurality of rolling balls 36. The outer race of each bearing is secured to the inner surface of one end of the cushion tube 28 to accordingly mount the tube in substantially coaxial relation with the bar 12 and sleeve 24.

It will be appreciated that the antifriction bearings mount the cushion tube for axial sliding movement on the bar as well as for rotary movement about the bar. These bearings may also take forms other than those described above.

Referring again to FIG. 1, a coil spring 38 loosely encircles the bar between each bearing 30 and one shoulder 26 of the sleeve 24 to resiliently resist approach of the associated bearing toward the sleeve and thereby limit the extent of axial sliding movement of the tube and confine the tube to positions generally central of the bar. Thus the sleeve 24 comprises an anti-movement means.

As further shown in FIGS. 1 and 2, the cushion tube 28 is provided with an outer covering 40 of a cushioning material such as foam rubber or any other suitable material. This cushion is intended to make use of the device more comfortable.

Figure 3B:
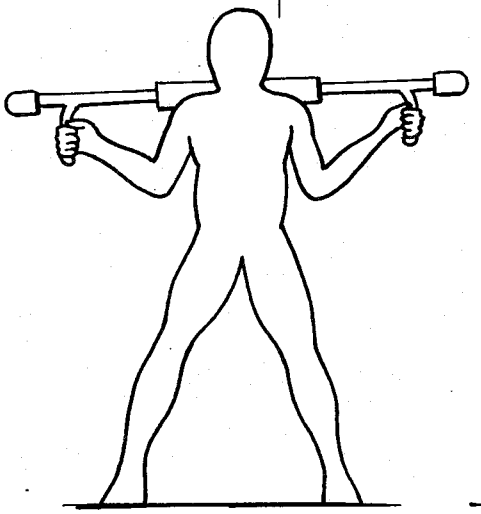
FIGS. 3A, 3B, and 3C are generally diagrammatic views of stages of one exercise regimen using the exercise device of the present invention.
Figure 3A:
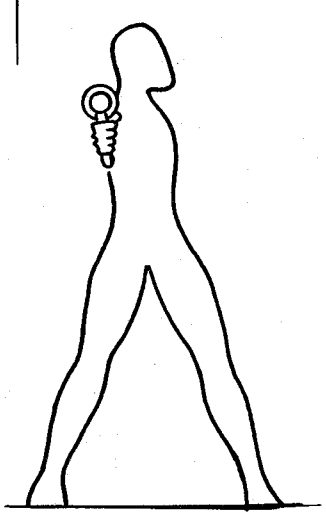
Figure 3C:
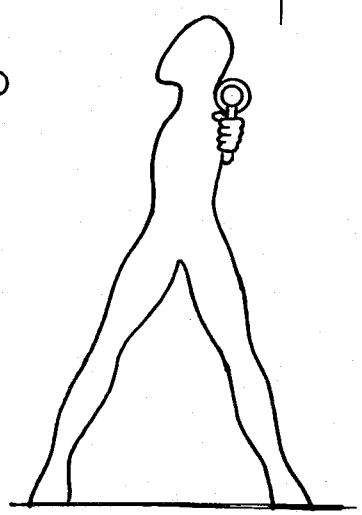

The device of the present invention may be used in a first exercise regimen shown in FIGS. 3A, 3B, and 3C. In this regimen, the respective hand grips 18 are grasped in each of the exerciser's hands. The bar is then placed behind the user's head with the cushion tube pressed against the back of the user's neck. With the user's toes pointed straight ahead, his or her feet approximately two feet apart, and the hand grips firmly held, the upper body is turned to one side while sliding the bar first to the similar side in the cushion tube as shown in FIG. 3A. The user then turns his upper body to the other side, sliding the bar in the opposite direction through the cushion tube as shown in FIG. 3C moving through the position shown in FIG. 3B. It is believed that the adjustable weights at the respective ends of the bar and the action of twisting the upper body while sliding the bar in the cushion tube stretches and tones the abdominal muscles mentioned above.

Figure 4A:
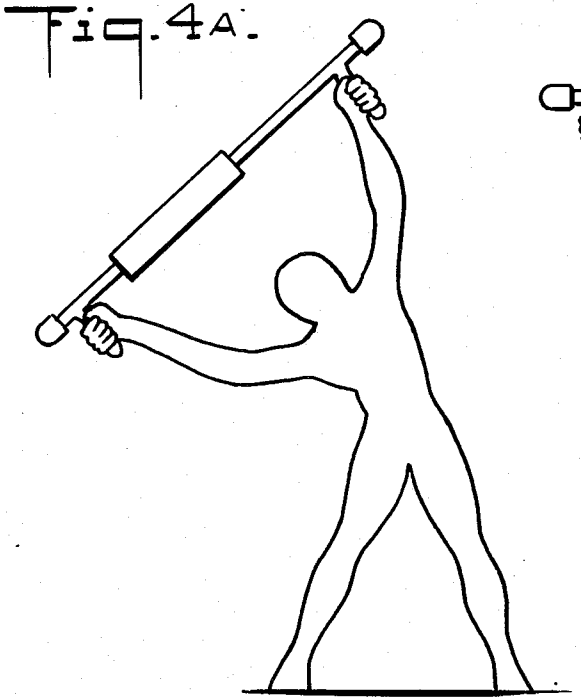
FIGS. 4A, 4B, and 4C are generally diagrammatic views of a second exercise regimen using the exercise device of the present invention.
Figure 4B:
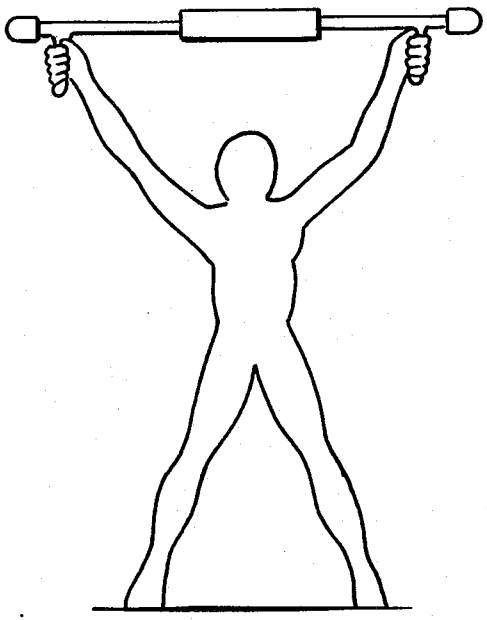
Figure 4C:
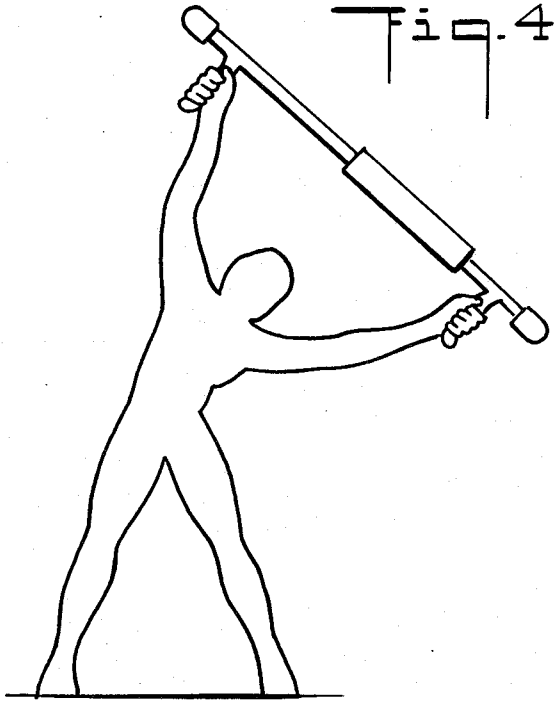

In the second exercise regimen, shown in FIGS. 4A, 4B, and 4C, the user points his or her toes straight ahead with his or her feet spaced approximately two feet apart. The respective hand grips are gripped in each of the user's hands and the device is held squarely over the head. Without moving the hips or twisting the upper body, the user bends from left (FIG. 4C) to right (FIG. 4A) through the upright position (FIG. 4B) and back again. It is believed that the action of the adjustable weights on each end of the bar and the sliding of the cushion tube along the bar create a tension that exercises the abdominal and dorsal muscles mentioned above. The tension caused by the cushion tube sliding along the bar may be explained scientifically by the change in center of gravity of the exercise device caused by the sliding, and thus the cushion tube comprises a destabilizing means.

Accordingly, it will be appreciated that the device of the present invention is simple and may be used in relatively uncomplicated regimens of exercises for firming and toning muscles that are otherwise difficult to exercise.

Accordingly, although a specific embodiment of the present invention has been described above in detail, it is to be understood that this is for purposes of illustration. Modifications may be made to the described exercise device in order to adapt it to particular applications.

What is claimed is:

1. An exercise device comprising:

an elongate bar;

destabilizing means comprising an axially slidable cushion tube shorter than said bar, said cushion tube mounted in telescoping relation about said bar and having an inner diameter greater than the diameter of said bar;

antifriction bearing means for mounting said cushion tube for rotary and axial sliding movement in telescoping relation about said bar at a location intermediate the ends of said bar;

anti-movement means for limiting the extent of said axial sliding movement of said tube relative to said bar to confine said tube to positions generally at the center of said bar;

a first hand grip and a second hand grip, said first hand grip mounted in fixed position on said bar and on one side of said cushion tube, said second hand grip mounted in fixed position on said bar on the opposite side of said cushion tube;

a first weight and a second weight, said first weight positioned in a region at one end of the bar and said second weight position in a region at the opposite end of the bar; and said destabilizing means for altering the center of gravity of the exercise device while the users hands remain on said first and said second hand grips.

2. The exercise device according to claim 1, wherein said antifriction bearing means comprises a bushing mounted within said tube at each end thereof and in axial sliding engagement with said bar.

3. The exercise device according to claim 2 wherein said antimovement means comprises a sleeve mounted in fixed position on said bar at the center thereof and having an outside diameter larger than the inside diameter of each of said bushings but smaller than the inside diameter of said tube.

4. The exercise device according to claim 3, further comprising resilient means for resiliently resisting the approach of each of said bushings toward said sleeve during the axial sliding movement of said tube on said bar.

5. The exercise device according to claim 4, wherein said resilient means comprises a pair of coil springs, each loosely mounted in encircling relation about said bar between one said bushing and said sleeve.

6. The exercise device according to claim 1, wherein said hand grips project in generally coplanar relation generally perpendicularly from said bar in the region of opposite ends of said bar.

7. The exercise device according to claim 6, further comprising a layer of cushioning material mounted on the outer surface of said tube.

8. An exercise device comprising:

an elongate bar;

destabilizing means comprising an axially slidable cushion tube shorter than said bar, said cushion tube mounted in telescoping relation about said bar and having an inner diameter greater than the diameter of said bar;

a pair of antifriction bushings, each mounted within said tube at each end thereof and in axial sliding engagement with said bar, for mounting said tube for axial sliding movement in telescoping relation about said bar, and for rotary movement relative to said bar;

a sleeve mounted inside the cushion tube in fixed position at the center of said bar; and having an outside diameter larger than the inside diameter of each of said bushings but smaller than the inside diameter of said tube;

a pair of coil springs, each loosely mounted in encircling relation about said bar between one said bushing and said sleeve to thereby resiliently resist approach of each of said bushings toward said sleeve and limit the extent of axial sliding movement of said tube on said bar to a position generally at the center of said bar;

a first hand grip and a second hand grip, said first hand grip mounted in fixed position with said bar on one side of said cushion tube and said second hand grip mounted in fixed position with said bar on the opposite side of said cushion tube;

a first weight and a second weight, said first weight positioned in a region at one end of the bar and said second weight positioned in a region at the opposite end of the bar; and said destabilizing means for altering the center of gravity of the exercise device while the users hands remain on said first and said second hand grips.

* * * * *